US008888205B2

(12) United States Patent
Sakai et al.

(10) Patent No.: US 8,888,205 B2
(45) Date of Patent: Nov. 18, 2014

(54) PRINTING DEVICE, PRINTING METHOD, AND MEDIUM HAVING RECORDED PROGRAM

(75) Inventors: Hirofumi Sakai, Shiojiri (JP); Mitsuhiro Yamashita, Matsumoto (JP); Seishin Yoshida, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 95 days.

(21) Appl. No.: 13/446,038

(22) Filed: Apr. 13, 2012

(65) Prior Publication Data

US 2012/0262509 A1 Oct. 18, 2012

(30) Foreign Application Priority Data

Apr. 14, 2011 (JP) ..... 2011-089758

(51) Int. Cl.
*B41J 29/38* (2006.01)
*B41J 2/21* (2006.01)

(52) U.S. Cl.
CPC ..... *B41J 2/2117* (2013.01)
USPC ..... 347/6; 347/5; 347/9; 347/101; 347/102

(58) Field of Classification Search
CPC ..... B41J 29/38
See application file for complete search history.

(56) References Cited

U.S. PATENT DOCUMENTS 6,480,217 B1 * 11/2002 Inoue et al. ..... 347/212
7,244,021 B2 * 7/2007 Arai ..... 347/102
7,407,277 B2 8/2008 Yoneyama
7,562,957 B2 7/2009 Mills et al.
2006/0061625 A1 * 3/2006 Konno et al. ..... 347/55
2007/0188547 A1 8/2007 Kobayashi et al.
2010/0053247 A1 * 3/2010 Kakutani ..... 347/12
2010/0177131 A1 7/2010 Yoshida
2010/0207987 A1 8/2010 Sano
2011/0018917 A1 * 1/2011 Fujisawa et al. ..... 347/8
2011/0221805 A1 * 9/2011 Yoshida et al. ..... 347/9
2011/0221807 A1 * 9/2011 Yoshida ..... 347/9
2011/0234660 A1 9/2011 Yoshida
2012/0056922 A1 3/2012 Yoshida

FOREIGN PATENT DOCUMENTS

JP 2007-050555 A 3/2007
JP 2010-158888 A 7/2010
JP 2010-166152 A 7/2010
JP 2011-201151 A 10/2011

* cited by examiner

*Primary Examiner* — Manish S Shah
*Assistant Examiner* — Jeremy Delozier
(74) *Attorney, Agent, or Firm* — Global IP Counselors, LLP

(57) ABSTRACT

To provide a technique when printing using a light-shielding ink and a special glossy ink, the printing device includes an affixing part for affixing ink to a printing medium, and a controller for controlling ink volumes of a colored ink, a light-shielding ink having light-shielding properties, and a special glossy ink having special gloss. The controller has a field discriminating part for discriminating an overlap field of a light-shielding ink field and a special glossy ink field; and a part for allowing, in the overlap field, the ink volume of light-shielding ink to be brought lower than the ink volume of the light-shielding ink determined in accordance with the image data, irrespective of the overlap field.

8 Claims, 10 Drawing Sheets

FIRST PRINTING SEQUENCE MODE (STANDARD MODE)
(PRINTING MEDIUM: TRANSPARENT PRINTING MEDIUM)

SECOND PRINTING SEQUENCE MODE (STANDARD MODE)
(PRINTING MEDIUM: TRANSPARENT PRINTING MEDIUM)

THIRD PRINTING SEQUENCE MODE (STANDARD MODE)
(PRINTING MEDIUM: NON-TRANSPARENT PRINTING MEDIUM)

FIRST PRINTING SEQUENCE MODE (REDUCTION MODE)
(PRINTING MEDIUM: TRANSPARENT PRINTING MEDIUM)

SECOND PRINTING SEQUENCE MODE (REDUCTION MODE)
(PRINTING MEDIUM: TRANSPARENT PRINTING MEDIUM)

THIRD PRINTING SEQUENCE MODE (REDUCTION MODE)
(PRINTING MEDIUM: NON-TRANSPARENT PRINTING MEDIUM)

PRINTING DEVICE, PRINTING METHOD, AND MEDIUM HAVING RECORDED PROGRAM

CROSS-REFERENCE TO RELATED APPLICATIONS

This application claims priority to Japanese Patent Application No. 2011-089758 filed on Apr. 14, 2011. The entire disclosure of Japanese Patent Application No. 2011-089758 is hereby incorporated herein by reference.

BACKGROUND

1. Technical Field

The present invention relates to a technology for printing an image on a printing medium.

2. Background Technology

With printers that are used as printing devices, printing is carried out by discharging ink onto a printing medium from a printing head. In addition to colored inks, white inks having light shielding characteristics and metallic inks having special gloss are discharged from printing heads onto printing media (e.g., Patent Document 1).

Japanese Laid-open Patent Publication No. 2007-50555 (Patent Document 1) is an example of the related art.

SUMMARY

However, when white ink having light-shielding properties and metallic ink having special gloss are printed on a printing medium so that they overlap, there are cases where the glossy appearance imparted to the printed image by the metallic ink is decreased. This type of problem is not restricted to cases in which metallic ink and white ink are printed so that they overlap. This problem also occurs in cases where a light-shielding ink having light-shielding properties and a special glossy ink having special gloss are printed so that they overlap.

Consequently, an advantage of the invention is to provide a technology whereby a decrease in the glossy appearance of a special glossy ink is inhibited when printing is carried out using a light-shielding ink and a special glossy ink.

The invention is developed in order to resolve at least some of the above problems and can be worked in the form of the following modes and application examples.

Application Example 1

A printing device for printing an image, including an affixing part for affixing ink to a printing medium; and a controller for controlling the ink volumes of each of a colored ink, a light-shielding ink having light-shielding properties, and a special glossy ink having special gloss that are respectively affixed to the printing medium from the affixing part;

the controller further including a field discriminating part for discriminating an overlap field of a light-shielding ink field in which a light-shielding ink is employed and a special glossy ink field in which a special glossy ink is employed in a field in which the image is to be formed in accordance with image data;

and an ink volume controller for allowing, in the overlap field, the ink volume of light-shielding ink to be brought lower than the ink volume of the light-shielding ink determined in accordance with the image data, irrespective of the overlap field.

In accordance with the printing device described in Application Example 1, the ink volume of light-shielding ink can be reduced in overlap fields by the controller. By reducing the ink volume of light-shielding ink, a decline in the glossy appearance of the special glossy ink in the overlap fields can be inhibited. In addition, consumption of light-shielding ink can be reduced.

Application Example 2

The printing device according to Application example 1, wherein the ink volume controller adjusts to zero the ink volume of light-shielding ink that is affixed to the printing medium from the affixing part in the overlap field. In accordance with the printing device of Application Example 2, the ink volume of light-shielding ink in the overlap field is set to zero by the controller. As a result, a decline in glossy appearance of the special glossy ink in the overlap field can be inhibited. In addition, consumption of light-shielding ink can be reduced.

Application Example 3

The printing device according to Application Example 1 or Application Example 2, wherein the controller also includes a selection part for allowing the user to select whether or not the ink volume of the light-shielding ink is to be reduced by the ink volume controller. In accordance with the printing device of Application Example 3, operability when the user is printing data is improved because the user can use the selection part to select whether or not the ink volume of the special glossy ink is to be reduced.

Application Example 4

The printing device according to any of Application Examples 1 to 3, wherein the special glossy ink is a metallic ink. In accordance with the printing device of Application Example 4, a Metallic ink is used as the special glossy ink, allowing printing having a metallic glossy appearance to be carried out.

Application Example 5

The printing device according to any of Application Examples 1 to 4, wherein the light-shielding ink is white ink. In accordance with the printing device of Application Example 5, by using white ink as the light-shielding ink, it is possible to prevent dramatic decrease in the brightness of the printed image.

Application Example 6

The printing device according to any of Application Examples 1 to 5, wherein the printing medium is a transparent printing medium that has light-transmissive properties. In accordance with the printing device of Application Example 6, an image can be formed on a transparent printing medium. As a result, a printing medium can be provided whereby a printed image can be seen from the surface on the opposite side from the printed surface, in addition to a printed image that can be seen from the printed surface of the printing medium onto which various types of ink are affixed.

The invention can be embodied in a variety of configurations. In addition to the printing device described above, the invention can be embodied in modes such as a printing medium, a computer program in which a printing method is run on a computer, and a recording medium having a recorded program.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the invention are described in the following sequence:

A. Examples

B. Modification examples

A. Examples

A-1. System Configuration

Figure 1:
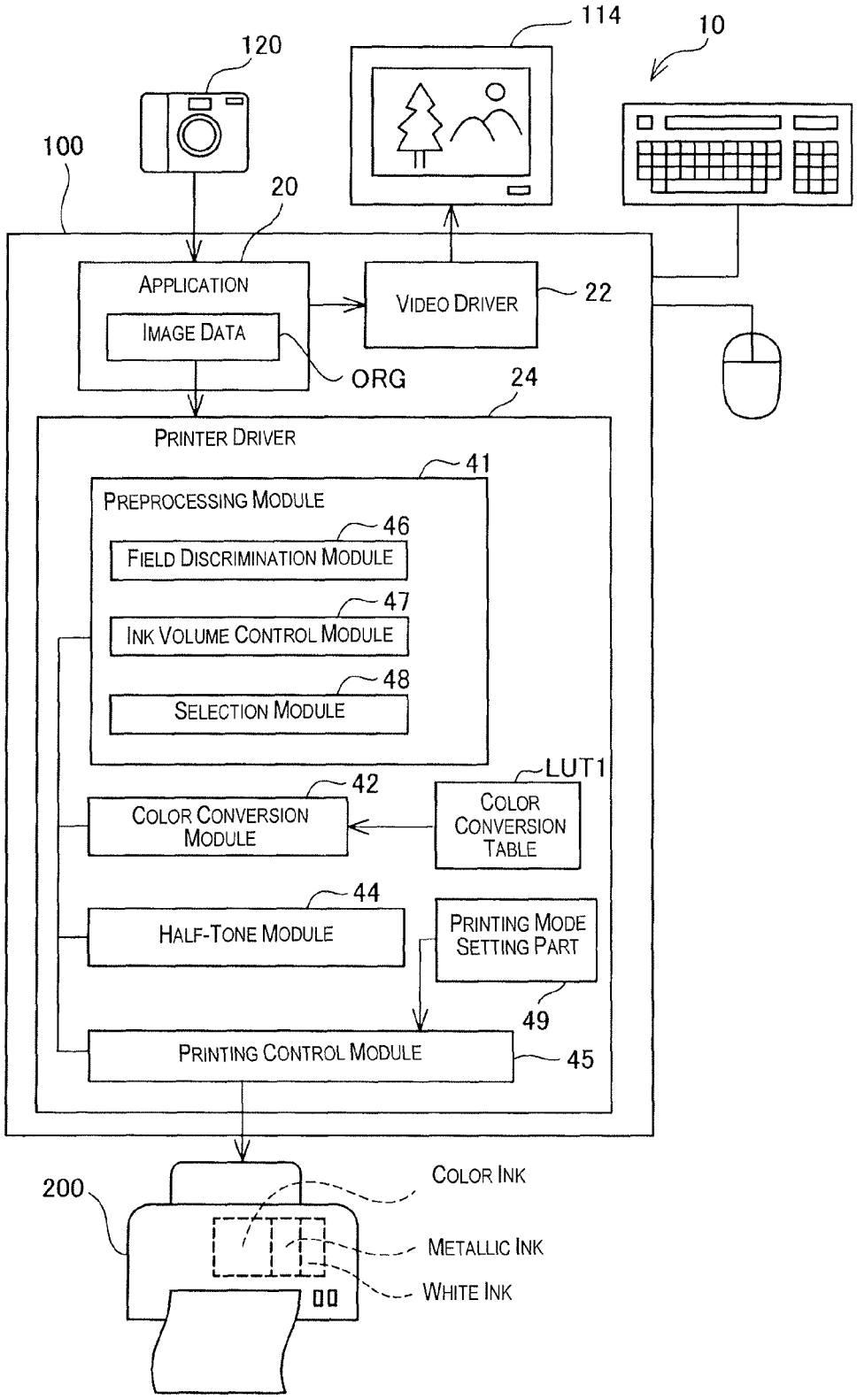
FIG. 1 is a schematic configuration diagram of the printing system 10 in an example of the invention.

FIG. 1 is a schematic configuration diagram of the printing system 10 in an example of the invention. The printing system 10 of this example includes a computer 100 used as a printing control device, and a printer 200 that is controlled by the computer 100 and prints an image on a printing medium. The printing system 10, taken as an integral whole, functions as a printing device broadly defined.

The printer 200 has colored ink, a white ink used as a light-shielding ink, and a metallic ink used as a special glossy ink. The colored ink, light-shielding ink, and special glossy ink are affixed onto printing media with different objectives.

The colored ink is used in order to provide the printing medium with color hue. Specifically, this colored ink is required for printing color images and monotone images. In this example, cyan ink, magenta ink, yellow ink, and black ink are used as colored inks. Any of the colored inks can be a pigment-based ink.

The light-shielding ink is used in order to provide the printing medium with light-shielding properties. Specifically, the light-shielding ink is used as a base layer for affixing various inks onto the printing medium. In other words, when the printing medium to which various inks are affixed is viewed from the observation side on which the user observes the image, this ink is formed as the lower-most layer (layer farthest from the user). By affixing the light-shielding ink, for example, onto a transparent printing medium, the printing medium is made non-transparent. An ink containing a pigment such as hollow resin particles or titanium dioxide particles can be used as the light-shielding ink. In this example, white ink containing white pigment is used as the light-shielding ink.

The special glossy ink is used in order to provide the printing medium with special gloss. Specifically, the special glossy ink is a texture-exhibiting ink that contains a pigment that exhibits a special texture. In this example, a metallic ink containing metal pigment that expresses a metallic appearance (e.g., metal foil) is used. The metal pigment, for example, can be formed from aluminum or aluminum alloy and can be produced by grinding metal vapor-deposited film. Other suitable components can be used as the metal pigment in the metallic ink, provided that the composition produces a metallic gloss.

In addition, special glossy inks are also describes as inks whose optical characteristics depend on the reflection angle when printed on the surface of a printing medium. In other words, the appearance (e.g., reflectance, brightness) of the special glossy ink that is affixed to the printing medium surface is different depending on the viewing angle.

A specified operating system is installed on the computer 100. An application program 20 is operated on this operating system. The operating system incorporates a video driver 22 and a printer driver 24. The application program 20, for example, inputs the image data ORG from the digital camera 120. When this occurs, the application program 20 displays the image represented by the image data ORG on a display 114 via the video driver 22. In addition, the application program 20 outputs image data ORG to the printer driver 24. The printer driver 24 then processes the input image data ORG by various methods described below, and the image data that has been processed (also referred to as "processed image data") is output to the printer 200.

In this embodiment, the image data ORG that is inputted from the digital camera 120 is data that is composed of three color components, red (R), green (G), and blue (B). The application program 20 affixes metal ink data and white ink data as necessary to the image data ORG that has been input from the digital camera 120. Affixing of this white ink data and metallic ink data can be carried out automatically by the application program 20 or in accordance with a command by the user. Of the data that is affixed to the image data ORG, fields in which white ink is affixed to the printing medium are also referred to as "white ink fields," and fields in which metallic ink is affixed to the printing medium are also referred to as "metallic ink fields." In addition, fields composed of R, G, B color components is also referred to as "color production fields."

In this example, the white ink field is automatically set by the application program 20, and the color production field and metallic field are set by the user. The color production fields, for example, are set under instructions from the user as fields within the image data where monochromatic printing or color printing is to be carried out. The metallic fields, for example, are set under instructions from the user as fields in which metallic appearance is to be produced within the image data. In addition, the white ink fields are set as fields in which there is overlap with a field in which one or both of the color production field or and the metallic ink field are positioned in accordance with the application program 20.

The printer driver 24 receives image data ORG from the application program 20 and converts the data to data that can be output to the printer 200. The printer driver 24 includes a preprocessing module 41 for processing the data contained in the image data ORG into appropriate data, a color conversion module 42 for performing color conversion, a color conversion table LUT 1 used for reference during color conversion, a half-tone module 44 for performing multiplexing subsequent to color conversion, a printing control module 45 for converting the multiplexed data into dot data for the respective colored inks, and a printing mode setting part 49 for setting the printing sequence mode.

The preprocessing module 41 includes a field discrimination module 46, an ink volume control module 47, and a selection module 48.

The field discrimination module 46 discriminates overlap between the white ink field and the metallic ink field in the image-forming fields in which the image is to be formed on the printing medium in accordance with the image data ORG that has been input to the printer driver 24. Specifically, the field discrimination module 46 discriminates and specifies the overlap field where the white field for imparting light-shielding properties to the printing medium on which the image is printed and the metallic ink field for producing a metallic appearance overlap. In this overlap field, the white ink field is formed as a base layer, and the metallic ink field is formed on a top part of the base layer.

The ink volume control module 47 sets the ink volume (dot recording ratio) per unit surface area for the white ink in the white ink field based on overlap field discrimination carried out by the field discrimination module 46. Specifically, the ink volume control module 47 sets the ink volume of the white ink in the overlap field to an ink volume (also referred to as "processed white ink volume") that is lower than the ink volume predetermined in the printer driver 24 based on the image data ORG ("also referred to as normal white ink volume"). In other words, the ink volume control module 47 sets the ink volume of the white ink in the overlap field to an ink volume that is lower than the normal white ink volume determined in accordance with the image data ORG without consideration of overlap fields. In this example, the normal white ink volume is set to 70%, and the processed white ink volume is set to 0%, in other words, zero.

With the selection module 48, the question of whether or not to reduce the ink volume per unit surface area of white ink in overlap fields is determined by the user by viewing the display on the display 114. In other words, the printing system 10 allows printing in two modes: a standard mode in which printing is carried out using the normal white ink volume and a reduction mode in which printing is carried out using the processed white ink volume.

The color conversion module 42 acts on the image data that has been processed by the processing module 41 and converts the respective color components R, G, and B in the color production field of the image data into color components that can be expressed by the printer 200 (cyan (C), magenta (M), yellow (Y), black (K)) in accordance with the color conversion table LUT 1. As a result, the data for the respective color components R, G, and B in the color production field is converted into ink volumes (dot recording ratios) for each ink color to be produced by the printer 200. In this example, the ink volume per unit surface area of metallic ink is set in the printer driver 24 at 30%. The reason that the ink volume of the metallic ink is set to 30% is that the increase in metallic appearance will be nearly unnoticeable if the ink volume exceeds 30%. The ink volume of the metallic ink is not limited to 30%, and can be set to a value such as 10% or 20%. In addition, the ink volume of the metallic ink can be divided into levels (e.g., 10%, 20%, 30%) so that the user can set the ink volume as desired.

The half-tone module 44 carries out half-tone processing in which the gray scale of image data that has been subjected to color conversion by the color conversion module 42 is represented as a dot distribution. In addition, half-tone processing is carried out in accordance with the white ink volume and metallic ink volume set by the application program 20 and the preprocessing module 41. In this example, the well-known ordered dithering method is used for half-tone processing. In addition to ordered dithering methods, error distribution methods, concentration pattern methods, and other half-tone technologies can be used for half-tone processing.

The printing control module 45 rearranges the dot arrangement in the generated dot data to produce order that is to be relayed to the printer 200 and outputs the data to the printer 200 as printing data. In addition, the printing control module 45 outputs various commands such as a start command or print end command to the printer 200, thereby controlling the printer 200.

The printing mode setting part 49 receives user commands concerning which printing sequence mode to carry out from among the first through third printing sequence modes prior to initiation of print processing and sets the printing sequence mode based on commands that have been received.

Figure 2A:
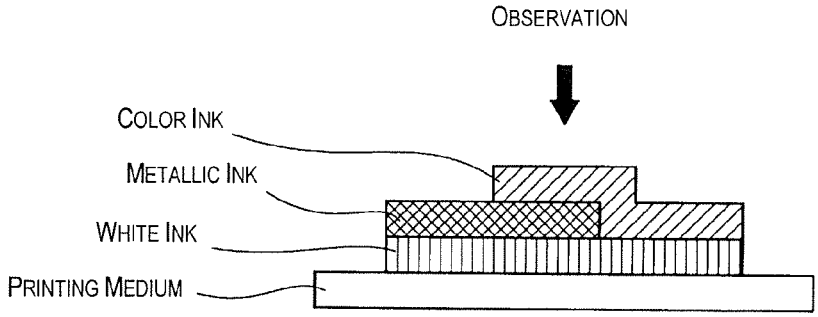
FIG. 2 is a diagram for illustrating the first through third printed surfaces which are standard modes.
Figure 2B:
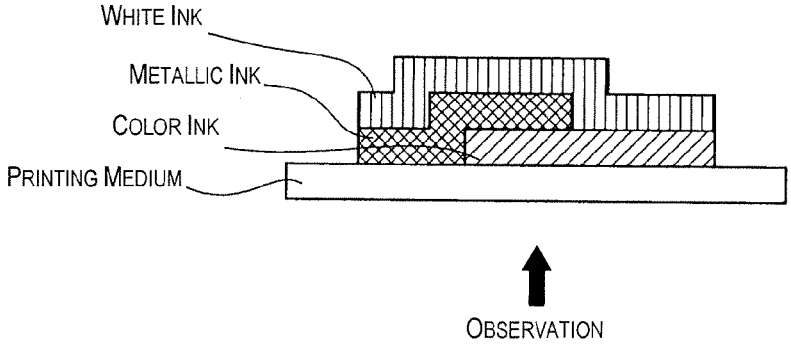
Figure 2C:
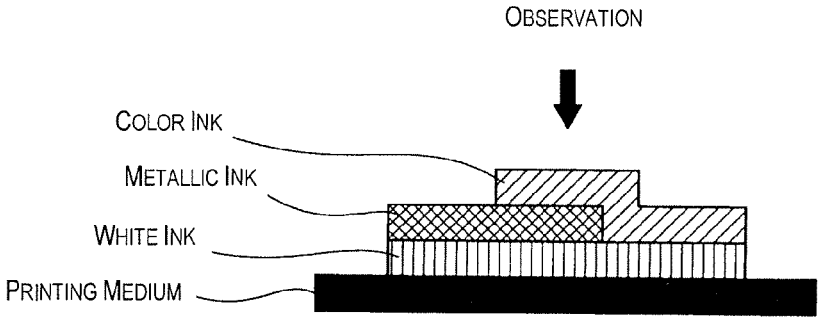

FIG. 2 is a diagram for illustrating the first through third printing sequence modes which are standard modes. FIG. 2A schematically presents a sectional view of the printing medium after printing has been carried out using the first printing sequence mode, which is a standard mode. FIG. 2B schematically presents a sectional view of the printing medium after printing has been carried out using the second printing sequence mode, which is a standard mode. FIG. 2C schematically presents a sectional view of the printing medium after printing has been carried out using the third printing sequence mode, which is a standard mode.

As shown in FIG. 2A, the first printing sequence mode utilizes a transparent printing medium having light-transmissive properties for the printing medium and is a printing mode that is used when the printed image is viewed from the printed surface. With the first printing sequence mode, white ink is first affixed to the transparent printing medium as light-shielding ink used for preserving concealing properties, thereby forming a white ink layer. The white ink is affixed to white ink fields in which at least one of a color production field and metallic field are positioned. Next, metallic ink is affixed to the metallic ink fields to form a metallic layer. Next, the respective colored inks (C, M, Y, and K) are affixed to the color production fields, thus forming a color production layer. Because white ink is used as light-shielding ink, decrease in the brightness of the printed image can be inhibited.

A shown in FIG. 2B, with the second printing sequence mode, a transparent printing medium having light-transmissive properties is used for the printing medium, and this printing mode is used when the printed image is to be viewed from the surface on the side that is opposite from the printed surface. With the second printing sequence mode, colored ink is first affixed to the color production field of the transparent printing medium. Next, metallic ink is affixed to the metallic ink field, and white ink is then lastly affixed to the white ink field.

As shown in FIG. 2C, with the third printing sequence mode, a non-transparent printing medium such as a paper medium or a printing medium composed of non-transparent plastic is used as the printing medium, and the printing sequence mode is used when the printed image is to be observed from the printed surface. With the third printing sequence mode, the order in which the inks are affixed to the printing medium is the same as with the first printing sequence mode described above. Specifically, the white ink used as light-shielding ink is first affixed to the non-transparent printing medium, whereupon metallic ink is affixed to the metallic ink fields. Lastly, the respective colored inks (C, M, Y, and K) are affixed to the color production fields.

Figure 3A:
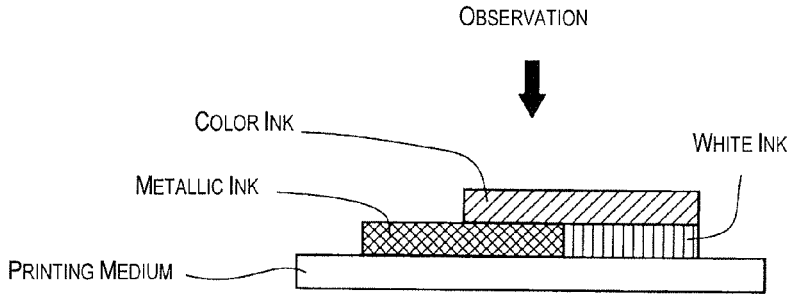
FIG. 3 is a diagram for illustrating the first through third printed surfaces which are reduction modes.
Figure 3B:
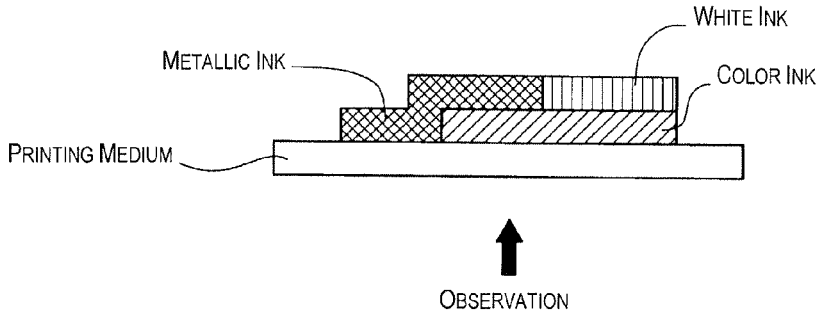
Figure 3C:
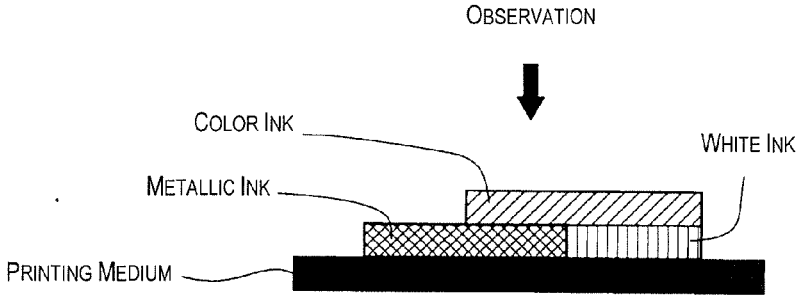

FIG. 3 is a diagram for illustrating the first through third printing sequence modes which are reduction modes. FIG. 3A schematically presents a sectional view of the printing medium after printing when printing has been carried out using the first printing sequence mode which is a reduction mode. FIG. 3B schematically presents a sectional view of the printing medium after printing has been carried out using the second printing sequence mode, which is a reduction mode. FIG. 3C schematically presents a sectional view of the printing medium after printing has been carried out using the third printing sequence mode, which is a reduction mode. With the first through third reduction printing sequence modes, the respective inks are affixed to the printing medium in the same manner as with the first through third standard printing sequence modes. With the first through third reduction printing sequence modes, as shown in FIGS. 3A to 3C, white ink is not affixed to the printing medium as the base layer in the fields where the metallic ink is affixed.

Figure 4:
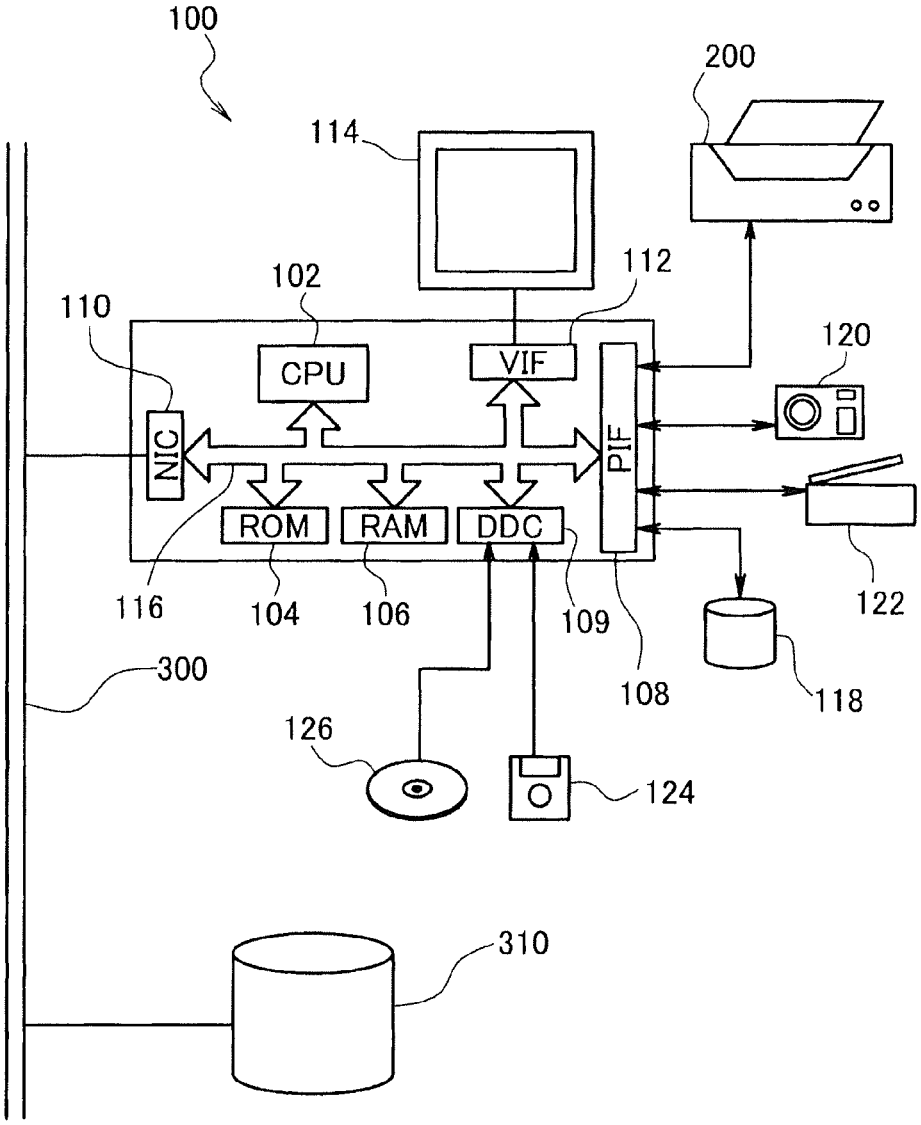
FIG. 4 is a schematic configuration diagram of the computer 100.

Next, the specific configuration of the computer 100 that is used as the printing control device will be described. FIG. 4 is a schematic configuration diagram of the computer 100. The computer 100 has a well-known configuration in which ROM 104, RAM 106, and the like are connected to each other via a bus 116 around a CPU 102.

A disk controller 109 for reading data from a floppy disk 124, compact disk 126, or the like, a peripheral device interface 108 for sending and receiving data with respect to peripheral devices, and a video interface 112 for driving the display 114, are connected to the computer 100. The printer 200 and the hard disk 118 are connected to the peripheral device interface 108. In addition, if a digital camera 120 or color scanner 122 is connected to the peripheral device interface 108, then it will be possible to carry out image processing on images that have been captured by the digital camera 120 or the color scanner 122. In addition, if a network interface card 110 is mounted, then data that has been recorded on a storage device 310 that is connected by a communication line can be acquired by connecting the computer 100 to a communication line 300. The computer 100 acquires image data that is to be printed, and then the printer 200 is controlled through operation of the printer driver 24 described above in order to print the image data.

Figure 5:
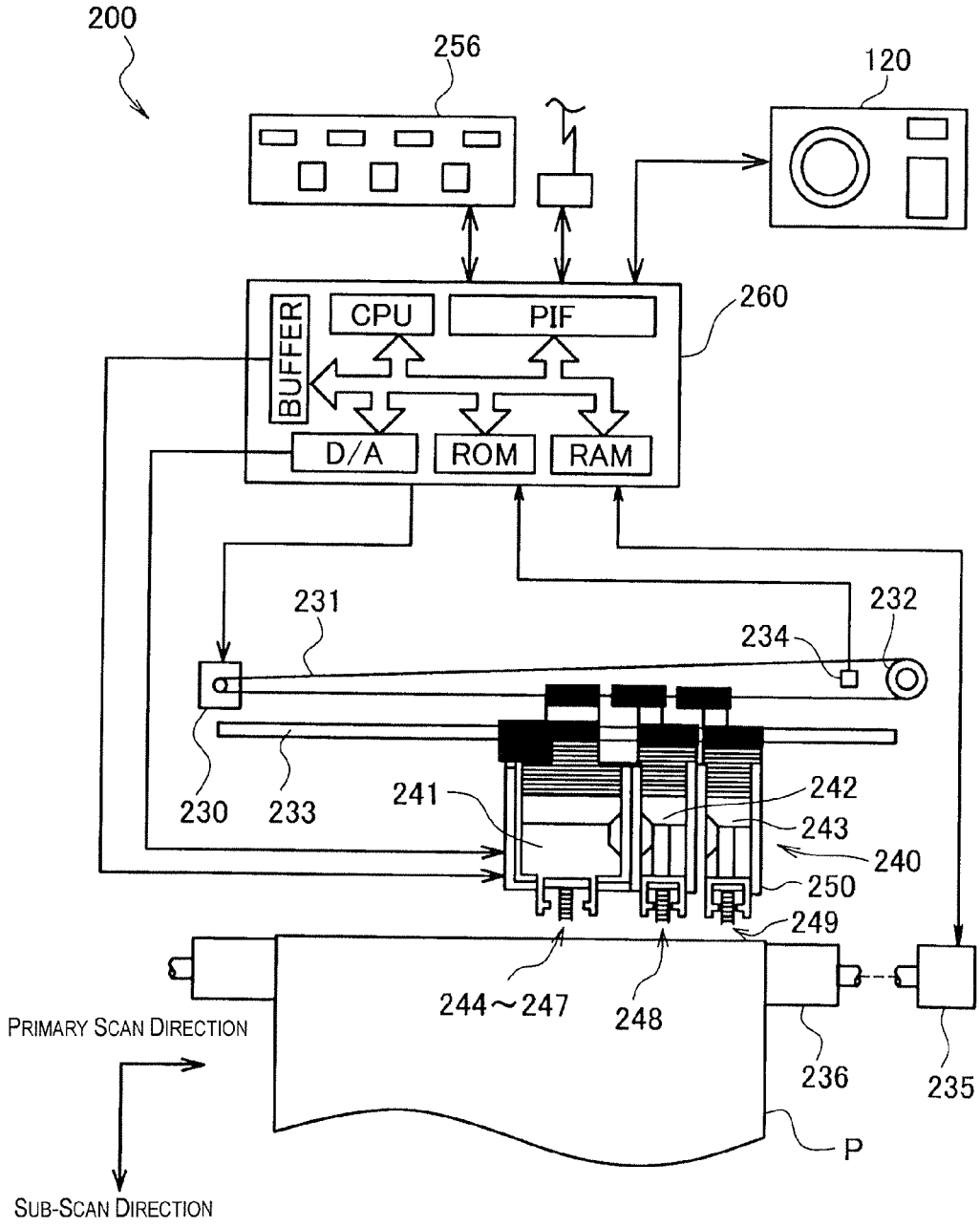
FIG. 5 is a block diagram showing the schematic configuration of the printer 200.

The configuration of the printer 200 will be described next. FIG. 5 is a block diagram showing the schematic configuration of the printer 200. As shown in FIG. 5, the printer 200 includes a mechanism for transporting a printing medium P by a paper feed motor 235, a mechanism for recursive movement of a carriage 240 in the axial direction of the platen 236 by a carriage motor 230, a mechanism for outputting inks and forming dots by driving a printing head 250 that is mounted on the carriage 240 and is used as the affixing part, and a control circuit 260 that can send and receive signals with respect to the paper feed motor 235, the carriage motor 230, the printing head 250, and an operating panel 256.

The mechanism for recursively moving the carriage 240 in the axial direction of the platen 236 includes a sliding shaft 233 that is erected parallel to the axis of the platen 236 and slidably supports the carriage 240, a pulley 232 on which an endless drive belt 231 is suspended between the pulley and the carriage motor 230, and a position detection sensor 234 that detects the origin position of the carriage 240.

On the carriage 240 are mounted colored ink cartridges 241 that respectively house magenta ink, yellow ink, and black ink that are used as colored inks. On the carriage 240 also are mounted a metallic ink cartridge 242 for housing a metallic ink, and a white ink cartridge 243 for housing a white ink. Six types of ink discharge heads 244 to 249 corresponding to each of these colors are formed on the printing head 250 on a bottom part of the carriage 240. When the ink cartridges 241, 242, and 243 are mounted from above on the carriage 240, ink can be supplied to the ink discharge heads 244 to 249 from the respective cartridges.

Figure 6A:
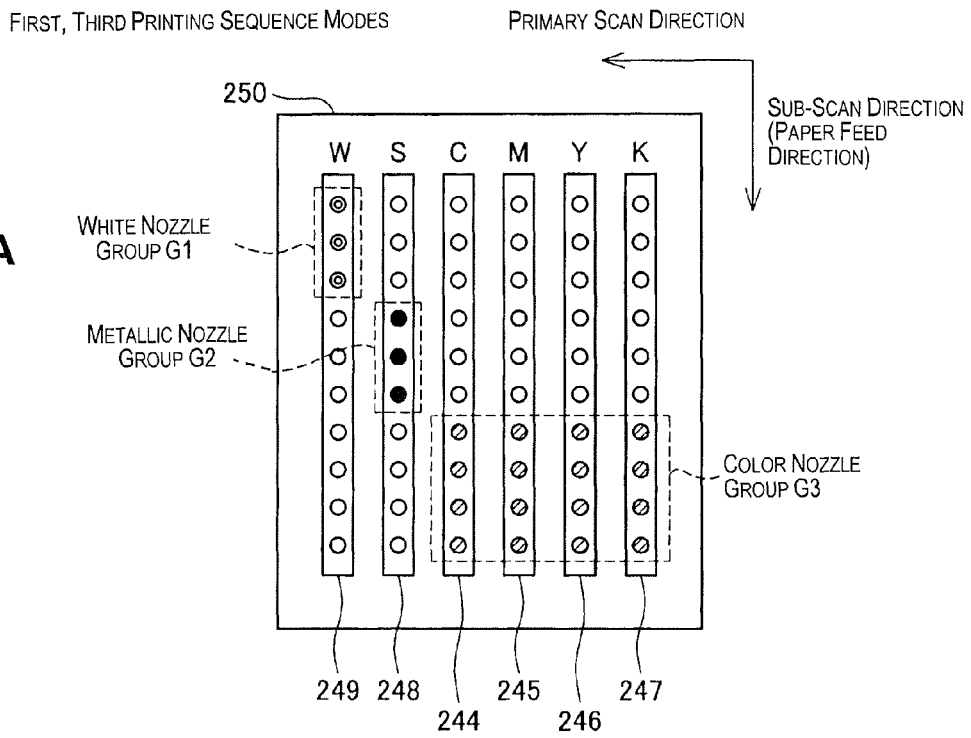
FIG. 6 is a descriptive diagram that schematically shows nozzle disposition on the ink discharge head.
Figure 6B:
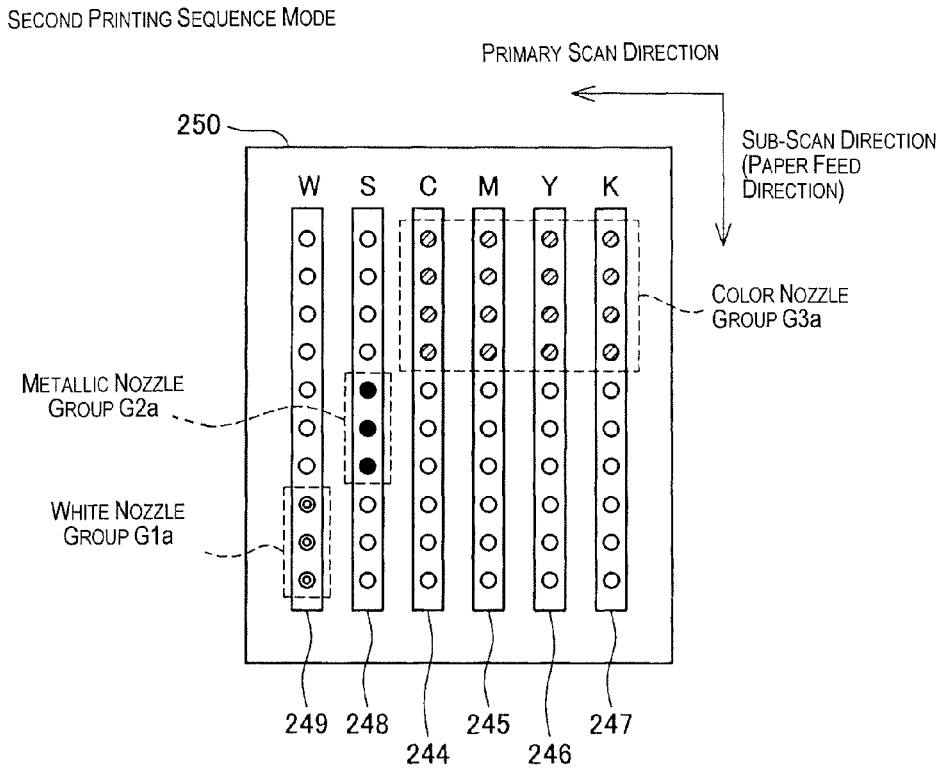

The printing head 250 will be described below. FIG. 6 is a descriptive diagram that schematically shows nozzle disposition on the ink discharge heads that constituted the printing head 250. FIG. 6A is a diagram for illustrating the nozzles that are used in the first printing sequence mode the third printing sequence mode. FIG. 6B is a diagram for illustrating the nozzles that are used in the second printing sequence mode. In FIG. 6A, the nozzles that are used are represented as white nozzle group G1, metallic nozzle group G2, and colored nozzle group G3. In FIG. 6B, the nozzles that are used are represented as white nozzle group G1*a*, metallic nozzle group G2*a*, and colored nozzle group G3*a*. Actually, 96 nozzles are provided for the inks of each color white (W), metallic (S), cyan (C), magenta (M), yellow (Y), and black (K). However, based on the drawing in FIG. 6, only ten nozzles are shown for each color. Although ten nozzles are presented for each color, the number of nozzles is set in accordance with the specifications of the printer 200.

The nozzles for discharging the ink of each color are arranged in the sub-scan direction on the bottom surface of the printing head 250. Each of the nozzles is disposed every three raster lines in the sub-scan direction, in other words, with a gap of 2 dots. In the drawing, the downwards direction denotes the sub-scan direction (paper feed direction). During printing, the printing location of the printing medium passes first by the nozzles that are represented as being the farthest upward.

As shown in FIG. 6A, when printing is executed in the first or third printing sequence modes, white ink, metallic ink, and colored ink are printed in sequence onto the printing medium P. Consequently, when printing is carried out in the first and third printing sequence modes in this example, among the nozzles for discharging white ink, the nozzles on the printing head 250 that are used are the first through third nozzles (white nozzle group G1) from the front in the sub-scan direction. Among the ten nozzles for discharging metallic ink, the fourth through sixth nozzles from the front in the sub-scan direction (metallic nozzle group G2) are used. For the nozzles for discharging colored inks, the seventh through tenth nozzles from the front in the sub-scan direction (color nozzle group G3) are used. By carrying out printing by scanning of the printing head 250 using the nozzles in this manner, white ink is affixed first to the printing medium P, whereupon metallic ink is affixed, followed lastly by the colored ink.

As shown in FIG. 6B, when printing is executed in the second printing sequence mode, printing of colored ink, metallic ink, and white ink is carried out in sequence on the printing medium P. Consequently, when printing is carried out in the second printing sequence mode, for the nozzles for discharging white ink, the nozzles on the printing head 250 that are used are the eighth through tenth nozzles from the front in the sub-scan direction (white nozzle group G1*a*). Of the ten nozzles for discharging metallic ink, the fifth through seventh nozzles from the front in the sub-scan direction are used (metallic nozzle group G2*a*). For the nozzles for discharging colored ink, the first through fourth nozzles from the front in the sub-scan direction (colored nozzle group G3*a*) are used. By carrying out printing with scanning of the printing head 250 using the nozzles in this manner, colored ink is first affixed to the printing medium P, whereupon metallic ink is affixed, followed lastly by white ink.

A piezo element is incorporated in each of the nozzles shown in FIG. 6. Piezo elements are elements in which the crystal structure deforms when voltage is applied and thereby converting electrical energy to mechanical energy at extremely high speed. In this example, by applying a voltage signal (drive signal) to a piezo element, the wall on one side of an ink passage in the nozzle is deformed, so that ink droplets are discharged from the nozzle. In this example, ink is discharged using piezo elements, but a format can be adopted in which ink is discharged by generating bubbles in the nozzles.

Control of the printing head 250 described above is carried out by the control circuit 260 of the printer 200 shown in FIG. 5. The control circuit 260 has a configuration in which a CPU, ROM, RAM, PIF (peripheral device interface) and the like are interconnected, and control of primary scanning and sub-scanning operations of the carriage 240 is carried out by controlling operation of the carriage motor 230 and the paper feed motor 235. In addition, when the printing data that has been output by the computer 100 is acquired via the PIF and the carriage 240 moves forward in the primary scan direction or moves backward in the primary scan direction, discharge of ink is controlled by supplying drive signals to the ink discharge heads 244 to 249 in accordance with the printing data, thereby printing the prescribed raster. When forward or backwards movement accompanying ink discharge is completed in the primary scan direction of the printing medium P, the control circuit 260 transports the printing medium P in the sub-scan direction, thereby providing medium for printing the subsequent raster. By repeating this operation, the printer 200 completes printing for each printing sequence mode in each printing mode (standard mode, reduction mode).

The printer 200 in this example was described as an ink jet printer for discharging ink droplets towards the printing medium P and thereby forms ink dots. However, the printer can be one that affixes ink to a printing medium using another technique. For example, instead of discharging ink droplets, static electricity can be used in order to attach toner particles to the printing medium, or the printer can take the form of a thermal transfer printer or sublimation type printer. In this example, the ink includes toner particles as well as ink droplets.

A-2. Print Processing

Print processing that is carried out by the printing system 10 is described below. Prior to initiation of print processing, the user uses the print setting screen that displays the application program 20 on the display 114 to enter print settings. The user designates the first through third printing sequence modes as print settings and designates the color production fields and metallic fields in the image data ORG.

Figure 7:
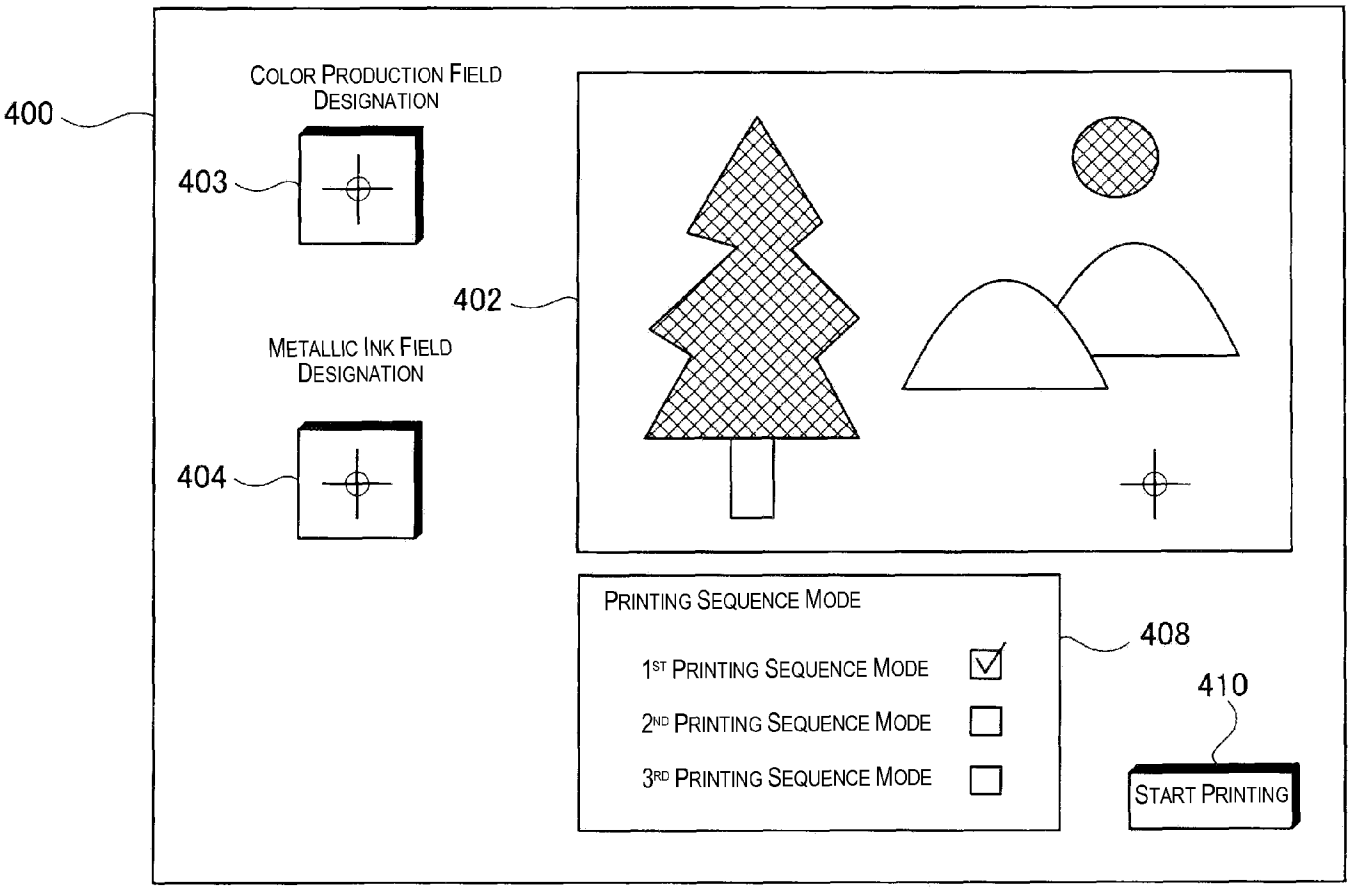
FIG. 7 is a descriptive diagram that shows the print setting screen 400.

FIG. 7 is a descriptive diagram showing the print setting screen 400 whereby the application program 20 is displayed on the display 114. The print setting screen 400 includes a print image display part 402, a color production field designation icon 403, a metallic field designation icon 404, a printing sequence mode selection part 408 and a print start button 410. The print image display part 402 displays the image to be printed corresponding to the image data ORG on the print settings screen 400. The color production field designation icon is an operational icon that is for the user to designate the color production fields in the image to be printed. The metallic field designation icon 404 is an operational icon for the user to designate the metallic fields in the image to be printed. The printing sequence mode selection part 408 is used in order for the user to select the first through third printing sequence modes. The print start button 410 is for the user to input the printing start command.

In the print setting screen 400, the user clicks on the color production field designation icon 403 for the image to be printed on the print image display part 402, and then a mouse pointing device is used in order to designate the color production fields in the image to be printed that is displayed on the print image display part 402. In addition, on the print setting screen 400, the user clicks on the metallic field designation icon 404 for the image to be printed on the print image display part 402 and then uses the mouse to designate the metallic fields in the image to be printed that is displayed on the print image display part 402. After designating a metallic appearance, the printing mode is selected using the printing sequence mode selection part 408. By then pressing the print start button 410, the application program 20 adds information concerning the metallic fields to the RGB format image data, generating supplemented image data in which information related to the white ink field has been automatically added. The supplemented image data is input to the printer driver 24 (FIG. 1), and processed image data is generated by data processing in the respective modules.

Figure 8:
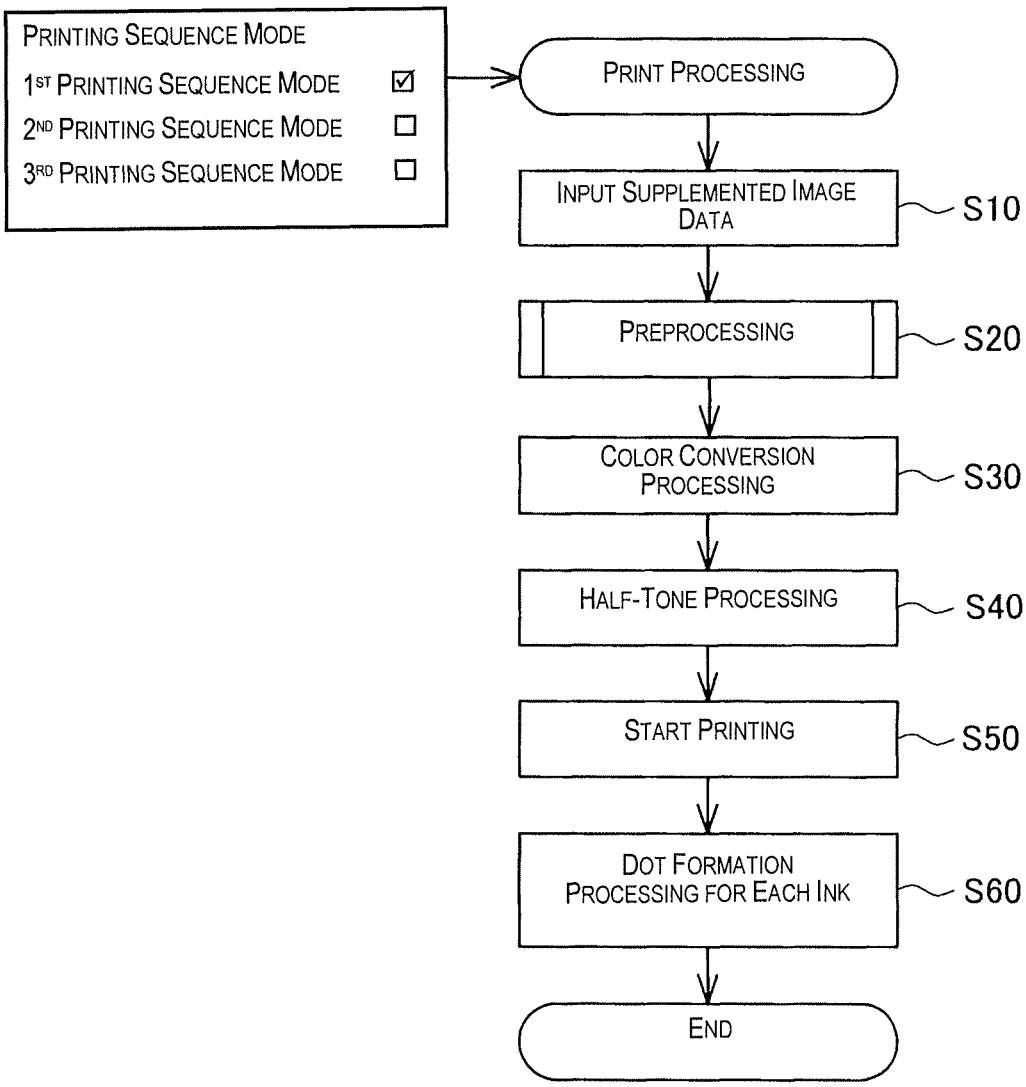
FIG. 8 is a flow chart showing the sequence of print processing carried out by the printing system 10.

FIG. 8 is a flow chart that shows the sequence of print processing that is carried out by the printing system 10. When the print operation is started, supplemented image data is input to the printer driver 24 (step S10). The supplemented image data that has been input to the printer driver 24 is preprocessed by the preprocessing module (step S20). Details concerning preprocessing are described below.

Color conversion processing of the supplemented image data by the color conversion module 42 is then started (step S30). Specifically, the data is converted to CMYK-format image data based on the RGB components contained in the supplemented image data (step S30). Upon obtaining the CMYK-format image data, the half-tone module 44 carries out half-tone processing on the CMYK-format image data (step S40). At this point, the half-tone module 44 carries out half-tone processing on the metallic ink or white ink in addition to the colored ink. Specifically, the half-tone module 44 carries out half-tone processing so that the ink volume of metallic ink in the metallic fields is adjusted to 30%. For the white ink, half-tone processing is carried out so that the ink volume in overlap fields in which a white ink field overlaps with a metallic ink field is adjusted to 0%, and in fields other than overlap fields, half-tone processing is carried out so that the ink volume is adjusted to 70%.

Upon completion of half-tone processing, the printing control module 45 controls the printer 200, and printing is started (step S50). Once printing has started, the printer 200 carries out processing involving the formation of each ink dot (step S60). The processing involving formation of each ink dot is carried out over the entire range in which the image is to be formed on the printing medium in accordance with one of the first through third printing sequence modes that has been set.

Figure 9:
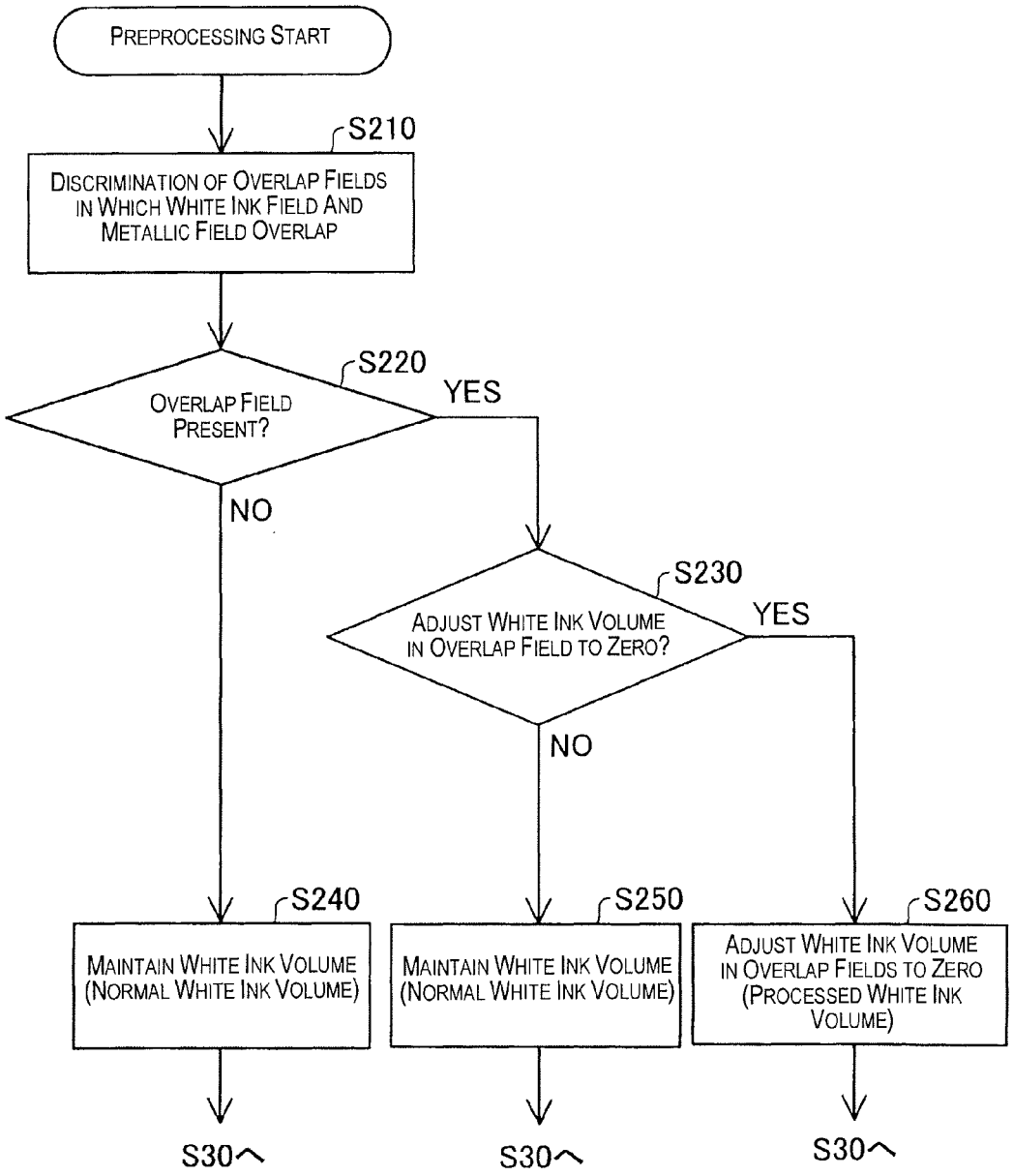
FIG. 9 is a flow chart showing the sequence of preprocessing.

FIG. 9 is a flow chart that shows the sequence of preprocessing that is executed by the preprocessing module 41. First, the field discrimination module 46 discriminates overlap between white ink fields and metallic ink fields in the supplemented image data in which metallic ink fields and white ink fields have been added to the RGB-format image data, thereby specifying the overlap fields (step S210). Discrimination of overlap fields can be carried out in pixel units or can be carried out in field units using a vector image expressing the metallic ink fields and white ink fields using coordinates. Specifically, as described above, the field discrimination module 46 discriminates and specifies the overlap field where the white ink field is formed as a base layer in relation to the supplemented image data, and the metallic ink field is overlappingly formed on the upper part of the base layer.

If the field discrimination module 46 discriminates that there are no overlap fields (step S220: No), then the ink volume control module 47 sets the ink volume of the white ink to the normal white ink volume (step S240). Processing beginning from step S30 is then carried out (FIG. 8).

On the other hand, if the field discrimination module 46 discriminates the presence of an overlap field (step S220: Yes), the selection module 48 allows the user to adjust the ink volume of the white ink in the overlap field to the normal white ink volume (in this example, 70% ink volume) or the processed white ink volume (in this example, 0% ink volume) and allows the user to make a selection via the display 114 (step S230). Specifically, in step S230, the user selects whether to adjust the ink volume of the white ink in the overlap fields to zero.

If the user decides to adjust the white ink volume to the standard ink volume (step S230: NO), then the ink volume control module 47 sets the ink volume of the white ink to the standard ink volume (step S250). Processing is then carried out starting from step S30 (FIG. 8). On the other hand, if the user decides to adjust the white ink volume in the overlap fields to the processed white ink volume (step S230: Yes), then the ink volume control module 47 sets the ink volume of the white ink to the processed white ink volume (step S260). Processing is then carried out starting from step S30 (FIG. 8).

Figure 10:
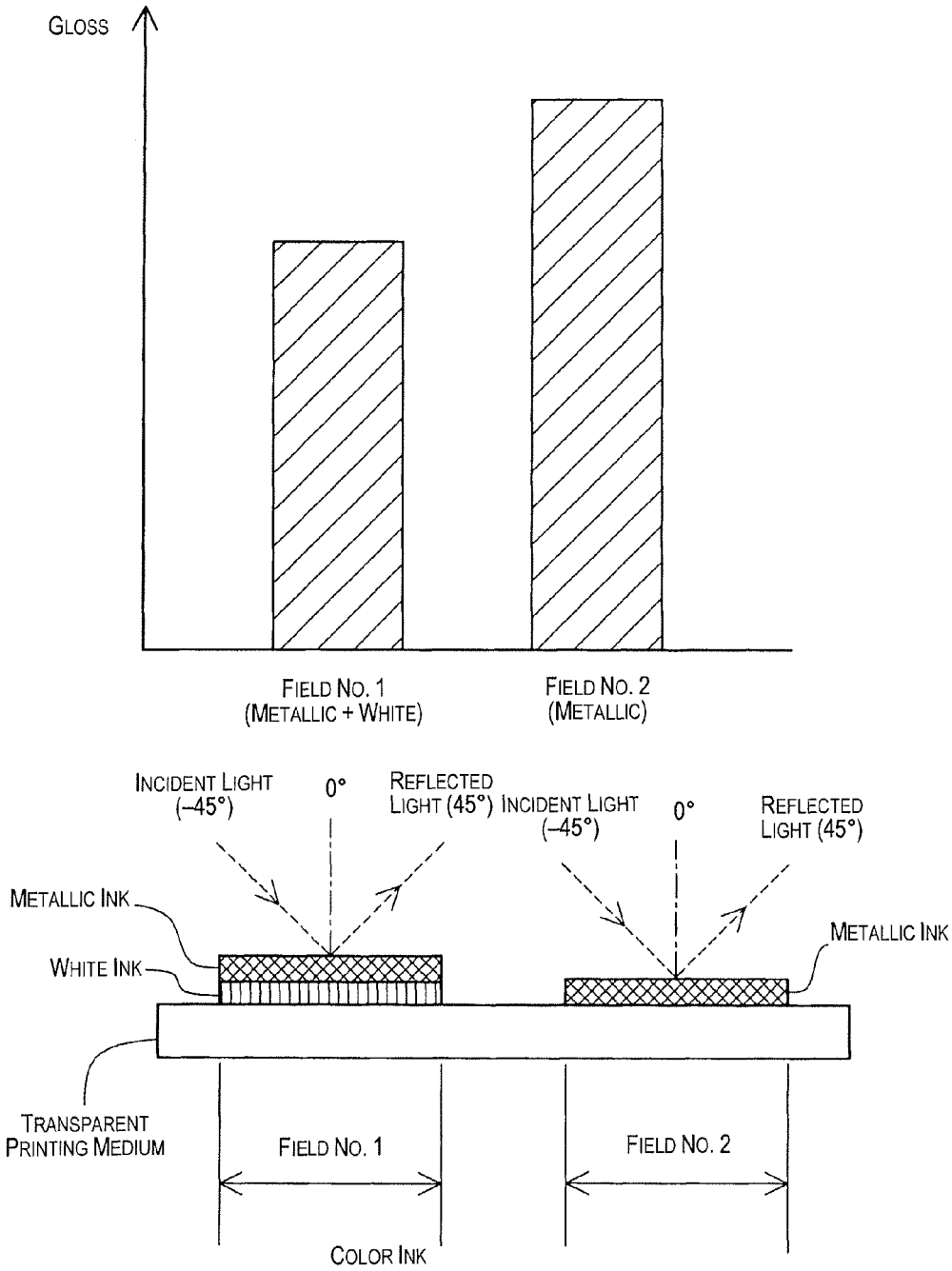
FIG. 10 is a diagram for illustrating one of the effects of the examples.

FIG. 10 is a diagram for illustrating one of the effects of this example. FIG. 10 is a diagram showing the gloss of field no. 1 and field no. 2. Field no. 1 and field no. 2 are respectively formed in different fields on a single transparent printing substrate. Field no. 1 is a field in which metallic ink and white ink are affixed to the printing medium in sequence from the side closest to the observation point. In addition, field no. 2 is a field in which metallic ink alone is affixed to the transparent printing medium. The compositions of the metallic inks that are used in field no. 1 and field no. 2 are the same. In addition, the ink volume of the metallic ink was adjusted to 30% in both field no. 1 and field no. 2. Moreover, the ink volume of white ink in field no. 1 was adjusted to 70%. The gloss is defined as metallic appearance in this example, and when light was made incident at an angle of −45° with respect to the body to be measured (printing medium), bright reflected light was seen at an observation point located at an angle of 45°.

As shown in FIG. 10, low gloss was seen in field no. 1 relative to field no. 2. Specifically, field no. 1 was found to have a reduced metallic appearance in comparison to field no. 2. One reason for this is thought to be that when white ink is formed as a base layer, and a metallic ink layer is then formed on an upper part thereof, the surface of the white ink layer produces an uneven surface, and the metallic layer is formed on this uneven surface. Specifically, with metallic layers that are formed on uneven surfaces, the metallic appearance is thought to decrease due to scattered reflection of the light.

When a metallic layer is formed on a transparent medium that has light-transmissive properties, and a white ink layer is then formed on an upper part thereof; specifically, when the respective layers are formed using the second standard printing sequence mode shown in FIG. 2B, the metallic appearance will decrease in the same manner as with the results shown in FIG. 10. In general, when white ink is affixed on a metallic layer, or when a metallic ink is affixed on a white ink layer, the white ink readily penetrates (dissolves) into the metallic ink layer. Thus, when a white ink layer is formed on the metallic ink layer, one cause of the decrease in metallic appearance is thought to be due to penetration (dissolution) of white ink in the metallic ink layer.

As described above, in accordance with the printing system 10 of this example, overlap fields are discriminated by the preprocessing module 41, and the ink volume of white ink in the overlap fields is set to zero (step S260 of FIG. 9). As a result, a decline in the metallic appearance (glossy appearance) of the metallic ink in overlap fields can be inhibited, because the white ink will not be affixed to a bottom part of the metallic field. Because metallic inks contains metal pigment, they typically have concealing properties. Consequently, even when an image is printed on a printing medium having transparency, decreases in concealing properties in overlap fields can be inhibited, because the metallic ink is affixed in the overlap fields. Moreover, by setting the ink volume of the white ink in overlap fields to zero, the consumed amount of white ink can be reduced. In addition, with the printing system 10 in this example, the user selects whether to adjust the ink volume of the white ink in an overlap field to zero (step S230 in FIG. 9). As a result, operability can be improved when a user is printing image data.

B. Modification Example

Examples of the invention were described above, but the invention is not limited to these examples, and various configurations can be adopted that do not deviate from the scope of the invention. For example, the following types of modifications are possible.

B-1. First Modification Example

Although, in the above examples, settings involving adjusting the processed white ink volume to 0% (step S260 of FIG. 9) were carried out by the ink volume control module 47, but examples are not restricted thereby. Specifically, the processed white ink volume can be set to any value, provided that it is in a range that is smaller than the normal white ink volume (in the examples above, 70% ink volume). In this manner, the roughness of the white ink layer surface (specifically, the surface on which the metallic ink is to be formed) can be reduced, and the degree of penetration of white ink into the metallic layer can be reduced, thereby inhibiting loss of glossy appearance of the metallic ink in overlap fields.

B-2. Second Modification Example

In the examples described above, white ink was used as light-shielding ink, but any ink that has light-shielding properties can be used. For example, gray ink or the like can be used as the light-shielding ink. In the above examples, metallic ink was used as the special glossy ink, but the ink is not restricted thereto, and any ink having special gloss can be used. Examples of inks having special gloss include pearlescent inks containing a pigment in which thin film layers having a pearl color are multiply layered, as with natural pearl, lame inks containing a pigment having fine nonuniformities that manifests a lame or lacquered appearance by scattered reflection when affixed to the surface of a medium. In the examples described above, pigment-based inks were used as the colored inks, but dye-based inks can also be used.

B-3 Third Modification Example

In the examples described above, answering the question of whether to reduce the ink volume of the white ink in overlap fields was carried out by the user with the selection module 48 (step S230 of FIG. 9), but this step can be omitted. Specifically, when the field discrimination module 46 has discriminated that there is an overlap field, processing can be carried out to reduce the ink volume of white ink in the overlap field relative to the normal white ink volume (processing involving setting the volume to the processed white ink volume). In this manner, control of print processing can be simplified. In addition, the time required from the user instruction to begin printing to completion of printing can be shortened. In addition, in the same manner as in the above example, decrease in the glossy appearance of the metallic ink in overlap fields can be inhibited.

The entire disclosure of Japanese Patent Application No. 2011-089758, filed Apr. 14, 2011 is expressly incorporated by reference herein.

What is claimed is:

1. A printing device for printing an image, comprising:

an affixing part configured to affix ink to a printing medium; and a controller programmed to control ink volumes of each of a colored ink, a light-shielding ink having light-shielding properties, and a special glossy ink having special gloss that are respectively affixed to the printing medium from the affixing part;

the controller including a field discriminating part programmed to discriminate an overlap field in image data based on which the image is formed, the overlap field being a field in which a light-shielding ink field and a special glossy ink field overlap with respect to each other, the light-shielding ink being affixed to the light-shielding ink field, the special glossy ink being affixed to the special glossy ink field, and an ink volume controller programmed to control reducing, in the overlap field, the ink volume of the light-shielding ink to a first volume of the light-shielding ink that is smaller than a second ink volume of the light-shielding ink, the second ink volume being predetermined in accordance with the image data.

2. The printing device according to claim 1, wherein the ink volume controller adjusts to zero the ink volume of light-shielding ink that is affixed to the printing medium from the affixing part in the overlap field.

3. The printing device according to claim 1, wherein the controller also includes a selection part for allowing the user to select whether or not the ink volume of the light-shielding ink is to be reduced by the ink volume controller.

4. The printing device according to claim 1, wherein the special glossy ink is metallic ink.

5. The printing device according to claim 1, wherein the light-shielding ink is white ink.

6. The printing device according to claim 1, wherein the printing medium is a transparent printing medium that has light-transmissive properties.

7. A printing method in which a printing device prints an image onto a printing medium, the printing method further comprising:

discriminating an overlap field in image data based on which the image is formed, the overlap field being a field in which a light-shielding ink field and a special glossy ink field overlap with respect to each other, a light-shielding ink being affixed to the light-shielding ink field and a special glossy ink being affixed to the special glossy ink field in accordance with inputted image data in which the light-shielding ink field and the special glossy ink field are set; and printing the image while controlling reducing, in the overlap field, the ink volume of the light-shielding ink that is to be affixed to the printing medium to a first volume of the light-shielding ink that is smaller than a second ink volume of the light-shielding ink, the second ink volume being predetermined in accordance with the image data.

8. A medium for recording a computer program for printing an image using a printing device, the medium being a computer-readable medium for causing the computer to execute a field discrimination function for discriminating an overlap field in image data based on which the image is formed, the overlap field being a field in which a light-shielding ink field and a special glossy ink field overlap with respect to each other, a light-shielding ink being affixed to the light-shielding ink field and a special glossy ink being affixed to the special glossy ink field in accordance with inputted image data in which the light-shielding ink field and the special glossy ink field are set; and an ink volume control function for controlling reducing, in the overlap field, the ink volume of the light-shielding ink that is to be affixed to the printing medium to a first volume of the light-shielding ink that is smaller than a second ink volume of the light-shielding ink, the second ink volume being predetermined in accordance with the image data.

* * * * *